US011591899B2

(12) United States Patent
Ejim

(10) Patent No.: US 11,591,899 B2
(45) Date of Patent: Feb. 28, 2023

(54) WELLBORE DENSITY METER USING A ROTOR AND DIFFUSER

(71) Applicant: Saudi Arabian Oil Company, Dhahran (SA)

(72) Inventor: Chidirim Enoch Ejim, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 141 days.

(21) Appl. No.: 17/222,678

(22) Filed: Apr. 5, 2021

(65) Prior Publication Data

US 2022/0316319 A1 Oct. 6, 2022

(51) Int. Cl.
*E21B 47/06* (2012.01)
*E21B 43/12* (2006.01)

(52) U.S. Cl.
CPC ..... *E21B 47/06* (2013.01); *E21B 43/128* (2013.01)

(58) Field of Classification Search
CPC ..... E21B 47/06; E21B 43/128
See application file for complete search history.

(56) References Cited

U.S. PATENT DOCUMENTS

| | | | |
|---|---|---|---|
| 335,164 | A | 2/1886 | Vitalis |
| 646,887 | A | 4/1900 | Stowe et al. |
| 1,559,155 | A | 10/1925 | Bullock |
| 1,912,452 | A | 6/1933 | Hollander |
| 1,941,442 | A | 12/1933 | Moran et al. |
| 1,978,277 | A | 10/1934 | Noble |
| 2,204,857 | A | 6/1940 | Aladar |
| 2,216,315 | A | 10/1940 | Aladar |
| 2,287,027 | A | 6/1942 | Cummins |
| 2,556,435 | A | 6/1951 | Moehrl |

(Continued)

FOREIGN PATENT DOCUMENTS

| | | |
|---|---|---|
| CA | 1226325 | 9/1987 |
| CA | 2629578 | 10/2009 |

(Continued)

OTHER PUBLICATIONS

Abelsson et al., "Development and Testing of a Hybrid Boosting Pump," OTC 21516, Offshore Technology Conference (OTC), presented at the Offshore Technology Conference, May 2-5, 2011, 9 pages.

(Continued)

*Primary Examiner* — Michael R Wills, III
(74) *Attorney, Agent, or Firm* — Fish & Richardson P.C.

(57) ABSTRACT

This disclosure relates to an electric submersible pump assembly to measure a density of a fluid in a wellbore. The ESP assembly includes a density meter having a diffuser with an interior volume defined by an inner surface, a rotatable rotor arranged in the interior volume, a measurement channel, and a sensor sub-assembly configured to measure pressures in the measurement channel. The rotor includes a rotor channel defined by a first face of a partition of the rotor and an interior wall of the rotor, extends from an inlet to an outlet. The inlet is arranged at a first radial distance from an axis and the outlet is arranged at a second radial distance from the axis, greater than the first radial distance. The measurement channel, defined by the inner surface of the diffuser and a second face of the partition, extends from the outlet to the inlet.

28 Claims, 7 Drawing Sheets

(56) References Cited

U.S. PATENT DOCUMENTS 2,625,110 A 1/1953 Haentjens et al.
2,641,191 A 6/1953 Alfred
2,782,720 A 2/1957 Dochterman
2,845,869 A 8/1958 Herbenar
2,866,417 A 12/1958 Otto
2,931,384 A 4/1960 Clark
3,007,418 A 11/1961 Brundage et al.
3,022,739 A 2/1962 Herrick et al.
3,034,484 A 5/1962 Stefancin
3,038,698 A 6/1962 Troyer
3,123,010 A 3/1964 Witt et al.
3,129,875 A 4/1964 Cirillo
3,139,835 A 7/1964 Wilkinson
3,171,355 A 3/1965 Harris et al.
3,175,403 A 3/1965 Nelson
3,213,797 A 10/1965 McMahan
3,229,642 A 1/1966 Lobanoff
3,251,226 A 5/1966 Cushing
3,272,130 A 9/1966 Mosbacher
3,413,925 A 12/1968 Campolong
3,516,765 A 6/1970 Boyadjieff
3,638,732 A 2/1972 Huntsinger et al.
3,680,989 A 8/1972 Brundage
3,724,503 A 4/1973 Cooke
3,771,910 A 11/1973 Laing
3,795,145 A 3/1974 Miller
3,839,914 A 10/1974 Modisette et al.
3,874,812 A 4/1975 Hanagarth
3,961,758 A 6/1976 Morgan
3,975,117 A 8/1976 Carter
3,981,626 A 9/1976 Onal
4,025,244 A 5/1977 Sato
4,096,211 A 6/1978 Rameau
4,139,330 A 2/1979 Neal
4,154,302 A 5/1979 Cugini
4,181,175 A 1/1980 McGee et al.
4,226,275 A 10/1980 Frosch
4,266,607 A 5/1981 Halstead
4,289,199 A 9/1981 McGee
4,336,415 A 6/1982 Walling
4,374,530 A 2/1983 Walling
4,387,685 A 6/1983 Abbey
4,417,474 A 11/1983 Elderton
4,425,965 A 1/1984 Bayh, III et al.
4,440,221 A 4/1984 Taylor et al.
4,476,923 A 10/1984 Walling
4,491,176 A 1/1985 Reed
4,497,185 A 2/1985 Shaw
4,576,043 A 3/1986 Nguyen
4,580,634 A 4/1986 Cruise
4,582,131 A 4/1986 Plummer et al.
4,586,854 A 5/1986 Newman et al.
4,619,323 A 10/1986 Gidley
4,627,489 A 12/1986 Reed
4,632,187 A 12/1986 Bayh, III et al.
4,658,583 A 4/1987 Shropshire
4,662,437 A 5/1987 Renfro
4,665,981 A 5/1987 Hayatdavoudi
4,741,668 A 5/1988 Bearden et al.
4,757,709 A 7/1988 Czemichow
RE32,866 E 2/1989 Cruise
4,838,758 A 6/1989 Sheth
4,850,812 A 7/1989 Voight
4,856,344 A 8/1989 Hunt
4,867,633 A 9/1989 Gravelle
4,969,364 A 11/1990 Masuda
4,986,739 A 1/1991 Child
5,033,937 A 7/1991 Wilson
5,094,294 A 3/1992 Bayh, III et al.
5,158,440 A 10/1992 Cooper et al.
5,169,286 A 12/1992 Yamada
5,180,014 A 1/1993 Cox
5,195,882 A 3/1993 Freeman
5,201,848 A 4/1993 Powers
5,209,650 A 5/1993 Lemieux
5,246,336 A 9/1993 Furukawa
5,261,796 A 11/1993 Niemiec et al.
5,269,377 A 12/1993 Martin
5,285,008 A 2/1994 Sas-Jaworsky et al.
5,303,597 A 4/1994 Noren
5,323,661 A 6/1994 Cheng
5,334,801 A 8/1994 Mohn
5,335,542 A 8/1994 Ramakrishnan et al.
5,337,603 A 8/1994 McFarland et al.
5,358,378 A 10/1994 Holscher
5,482,117 A 1/1996 Kolpak
5,494,413 A 2/1996 Campen et al.
5,591,922 A 1/1997 Segeral et al.
5,605,193 A 2/1997 Bearden et al.
5,613,311 A 3/1997 Burtch
5,620,048 A 4/1997 Beauquin
5,641,915 A 6/1997 Ortiz
5,649,811 A 7/1997 Krol, Jr. et al.
5,653,585 A 8/1997 Fresco et al.
5,693,891 A 12/1997 Brown
5,736,650 A 4/1998 Hiron et al.
5,755,288 A 5/1998 Bearden et al.
5,834,659 A 11/1998 Ortiz
5,845,709 A 12/1998 Mack et al.
5,848,642 A 12/1998 Sola
5,880,378 A 3/1999 Behring
5,886,267 A 3/1999 Ortiz et al.
5,905,208 A 5/1999 Ortiz et al.
5,908,049 A 6/1999 Williams et al.
5,921,285 A 7/1999 Quigley et al.
5,954,305 A 9/1999 Calabro
6,113,675 A 9/2000 Branstetter
6,129,507 A 10/2000 Ganelin
6,148,866 A 11/2000 Quigley et al.
6,155,102 A 12/2000 Toma
6,164,308 A 12/2000 Butler
6,167,965 B1 1/2001 Bearden et al.
6,176,323 B1 1/2001 Weirich
6,179,269 B1 1/2001 Kobylinski et al.
6,192,983 B1 2/2001 Nemoth et al.
6,257,332 B1 7/2001 Vidrine et al.
6,264,440 B1 7/2001 Klein et al.
6,286,558 B1 9/2001 Quigley et al.
6,289,990 B1 9/2001 Dillon et al.
6,298,917 B1 10/2001 Kobylinski et al.
6,325,143 B1 12/2001 Scarsdale
6,357,485 B2 3/2002 Quigley et al.
6,361,272 B1 3/2002 Bassett
6,413,065 B1 7/2002 Dass
6,414,239 B1 7/2002 Gasque, Jr.
6,427,778 B1 8/2002 Beall et al.
6,454,010 B1 9/2002 Thomas et al.
6,463,810 B1 10/2002 Liu
6,530,211 B2 3/2003 Holtzapple et al.
6,544,013 B2 4/2003 Kato et al.
6,546,812 B2 4/2003 Lewis
6,547,519 B2 4/2003 deBlanc et al.
6,550,327 B1 4/2003 Van Berk
6,557,642 B2 5/2003 Head
6,601,460 B1 8/2003 Matema
6,601,651 B2 8/2003 Grant
6,604,550 B2 8/2003 Quigley et al.
6,619,388 B2 9/2003 Dietz et al.
6,629,564 B1 10/2003 Ramakrishnan et al.
6,679,692 B1 1/2004 Feuling et al.
6,681,894 B1 1/2004 Fanguy
6,726,449 B2 4/2004 James et al.
6,733,249 B2 5/2004 Maier et al.
6,741,000 B2 5/2004 Newcomb
6,755,609 B2 6/2004 Preinfalk
6,776,054 B1 8/2004 Stephenson
6,807,857 B2 10/2004 Storm, Jr.
6,808,371 B2 10/2004 Niwatsukino et al.
6,811,382 B2 11/2004 Buchanan et al.
6,848,539 B2 2/2005 Lee et al.
6,856,132 B2 2/2005 Appel et al.
6,857,452 B2 2/2005 Quigley et al.
6,863,137 B2 3/2005 Terry et al.
6,935,189 B2 8/2005 Richards

(56) References Cited

U.S. PATENT DOCUMENTS 6,993,979 B2 2/2006 Segeral
7,017,681 B2 3/2006 Ivannikov et al.
7,021,905 B2 4/2006 Torrey et al.
7,032,662 B2 4/2006 Malone et al.
7,086,294 B2 8/2006 DeLong
7,093,665 B2 8/2006 Dass
7,107,860 B2 9/2006 Jones
7,226,279 B2 6/2007 Andoskin et al.
7,259,688 B2 8/2007 Hirsch et al.
7,262,532 B2 8/2007 Seidler et al.
7,275,592 B2 10/2007 Davis
7,275,711 B1 10/2007 Flanigan
7,338,262 B2 3/2008 Gozdawa
7,377,312 B2 5/2008 Davis
7,562,587 B2 7/2009 Atkinson et al.
7,647,948 B2 1/2010 Quigley et al.
7,670,122 B2 3/2010 Phillips et al.
7,670,451 B2 3/2010 Head
7,699,099 B2 4/2010 Bolding et al.
7,730,937 B2 6/2010 Head
7,762,715 B2 7/2010 Gordon et al.
7,770,650 B2 8/2010 Young et al.
7,775,763 B1 8/2010 Johnson et al.
7,819,640 B2 10/2010 Kalavsky et al.
7,841,395 B2 11/2010 Gay et al.
7,841,826 B1 11/2010 Phillips
7,849,928 B2 12/2010 Collie
7,905,295 B2 3/2011 Mack
8,013,660 B2 9/2011 Fitzi
8,016,545 B2 9/2011 Oklejas et al.
8,066,033 B2 11/2011 Quigley et al.
8,067,865 B2 11/2011 Savant
8,197,602 B2 6/2012 Baron
8,235,126 B2 8/2012 Bradley
8,261,841 B2 9/2012 Bailey et al.
8,302,736 B1 11/2012 Olivier
8,337,142 B2 12/2012 Eslinger et al.
8,419,398 B2 4/2013 Kothnur et al.
8,506,257 B2 8/2013 Bottome
8,568,081 B2 10/2013 Song et al.
8,579,617 B2 11/2013 Ono et al.
8,771,499 B2 7/2014 McCutchen et al.
8,821,138 B2 9/2014 Holtzapple et al.
8,905,728 B2 12/2014 Blankemeier et al.
8,936,430 B2 1/2015 Bassett
8,950,476 B2 2/2015 Head
8,960,309 B2 2/2015 Davis
8,973,433 B2 3/2015 Mulford
9,080,336 B1 7/2015 Yantis
9,133,709 B2 9/2015 Huh et al.
9,157,297 B2 10/2015 Williamson, Jr.
9,200,932 B2 12/2015 Sittler
9,203,277 B2 12/2015 Kori et al.
9,234,529 B2 1/2016 Meuter
9,353,614 B2 5/2016 Roth et al.
9,383,476 B2 7/2016 Trehan
9,500,073 B2 11/2016 Alan et al.
9,540,908 B1 1/2017 Olivier
9,574,438 B2 2/2017 Flores
9,587,456 B2 3/2017 Roth
9,593,561 B2 3/2017 Xiao et al.
9,631,482 B2 4/2017 Roth et al.
9,677,560 B1 6/2017 Davis et al.
9,759,025 B2 9/2017 Vavik
9,759,041 B2 9/2017 Osborne
9,915,134 B2 3/2018 Xiao et al.
9,932,806 B2 4/2018 Stewart
9,951,598 B2 4/2018 Roth et al.
9,964,533 B2 5/2018 Ahmad
9,982,519 B2 5/2018 Melo
10,100,596 B2 10/2018 Roth et al.
10,138,885 B2 11/2018 Ejim et al.
10,151,194 B2 12/2018 Roth et al.
10,253,610 B2 4/2019 Roth et al.
10,273,399 B2 4/2019 Cox et al.
10,287,853 B2 5/2019 Ejim et al.
10,308,865 B2 6/2019 Cox et al.
10,323,644 B1 6/2019 Shakirov et al.
10,337,302 B2 7/2019 Roth et al.
10,337,312 B2 7/2019 Xiao et al.
10,378,322 B2 8/2019 Ejim et al.
10,465,477 B2 11/2019 Abdelaziz et al.
10,465,484 B2 11/2019 Turner et al.
10,487,259 B2 11/2019 Cox et al.
10,501,682 B2 12/2019 Cox et al.
10,533,558 B2 1/2020 Melo et al.
10,578,111 B2 3/2020 Xiao et al.
10,844,701 B2 11/2020 Xiao et al.
10,927,643 B2 2/2021 Ejim et al.
10,941,778 B2 3/2021 Xiao et al.
2002/0074742 A1 6/2002 Quoiani
2002/0079100 A1 6/2002 Simpson
2002/0109080 A1 8/2002 Tubel et al.
2002/0121376 A1 9/2002 Rivas
2002/0153141 A1 10/2002 Hartman
2003/0079880 A1 5/2003 Deaton et al.
2003/0141071 A1 7/2003 Hosie
2003/0161739 A1 8/2003 Chu et al.
2003/0185676 A1 10/2003 James
2003/0226395 A1 12/2003 Storm et al.
2004/0060705 A1 4/2004 Kelley
2005/0098349 A1 5/2005 Krueger et al.
2005/0166961 A1 8/2005 Means
2005/0217859 A1 10/2005 Hartman
2006/0066169 A1 3/2006 Daugherty et al.
2006/0076956 A1 4/2006 Sjolie et al.
2006/0096760 A1 5/2006 Ohmer
2007/0193749 A1 8/2007 Folk
2007/0212238 A1 9/2007 Jacobsen et al.
2008/0093084 A1 4/2008 Knight
2008/0187434 A1 8/2008 Neiszer
2008/0236842 A1 10/2008 Bhavsar et al.
2008/0262737 A1 10/2008 Thigpen et al.
2008/0264182 A1 10/2008 Jones
2008/0290876 A1 11/2008 Ameen
2008/0292454 A1 11/2008 Brunner
2009/0001304 A1 1/2009 Hansen et al.
2009/0016899 A1 1/2009 Davis
2009/0090513 A1 4/2009 Bissonnette
2009/0110579 A1 4/2009 Amburgey
2009/0151928 A1 6/2009 Lawson
2009/0151953 A1 6/2009 Brown
2009/0255669 A1 10/2009 Ayan et al.
2009/0289627 A1 11/2009 Johansen et al.
2009/0293634 A1 12/2009 Ong
2010/0040492 A1 2/2010 Eslinger et al.
2010/0122818 A1 5/2010 Rooks
2010/0206577 A1 8/2010 Martinez
2010/0236794 A1 9/2010 Duan
2010/0244404 A1 9/2010 Bradley
2010/0258306 A1 10/2010 Camilleri
2010/0288493 A1 11/2010 Fielder et al.
2010/0300413 A1 12/2010 Ulrey et al.
2011/0017459 A1 1/2011 Dinkins
2011/0024107 A1 2/2011 Sunyovszky et al.
2011/0024231 A1 2/2011 Wurth et al.
2011/0036568 A1 2/2011 Barbosa
2011/0036662 A1 2/2011 Smith
2011/0155390 A1 6/2011 Lannom et al.
2011/0162832 A1 7/2011 Reid
2011/0185805 A1 8/2011 Roux et al.
2011/0203848 A1 8/2011 Krueger et al.
2011/0278094 A1 11/2011 Gute
2011/0296911 A1 12/2011 Moore
2011/0300008 A1 12/2011 Fielder et al.
2012/0012327 A1 1/2012 Plunkett et al.
2012/0282119 A1 11/2012 Floyd
2013/0019673 A1 1/2013 Sroka et al.
2013/0300833 A1 1/2013 Perkins
2013/0048302 A1 2/2013 Gokdag et al.
2013/0051977 A1 2/2013 Song
2013/0066139 A1 3/2013 Wiessler
2013/0068454 A1 3/2013 Armistead
2013/0073208 A1 3/2013 Dorovsky

(56) References Cited

U.S. PATENT DOCUMENTS

| | | | | |
|---|---|---|---|---|
| 2013/0081460 | A1 | 4/2013 | Xiao et al. | |
| 2013/0175030 | A1 | 7/2013 | Ige | |
| 2013/0189123 | A1 | 7/2013 | Stokley | |
| 2013/0213663 | A1 | 8/2013 | Lau et al. | |
| 2013/0248429 | A1 | 9/2013 | Dahule | |
| 2013/0255370 | A1 | 10/2013 | Roux et al. | |
| 2013/0259721 | A1 | 10/2013 | Noui-Mehidi | |
| 2013/0272898 | A1* | 10/2013 | Toh | F04D 13/10 417/44.1 |
| 2014/0012507 | A1 | 1/2014 | Trehan | |
| 2014/0014331 | A1 | 1/2014 | Crocker | |
| 2014/0027546 | A1 | 1/2014 | Kean et al. | |
| 2014/0037422 | A1 | 2/2014 | Gilarranz | |
| 2014/0041862 | A1 | 2/2014 | Ersoz | |
| 2014/0116720 | A1 | 5/2014 | He et al. | |
| 2014/0144706 | A1 | 5/2014 | Bailey et al. | |
| 2014/0209291 | A1 | 7/2014 | Watson et al. | |
| 2014/0265337 | A1 | 9/2014 | Harding et al. | |
| 2014/0265654 | A1 | 9/2014 | Satterfield | |
| 2014/0341714 | A1 | 11/2014 | Casa | |
| 2014/0343857 | A1 | 11/2014 | Pfutzner | |
| 2014/0377080 | A1 | 12/2014 | Xiao et al. | |
| 2015/0068769 | A1 | 3/2015 | Xiao et al. | |
| 2015/0071795 | A1 | 3/2015 | Vazquez et al. | |
| 2015/0192141 | A1 | 7/2015 | Nowitzki et al. | |
| 2015/0233228 | A1 | 8/2015 | Roth | |
| 2015/0308245 | A1 | 10/2015 | Stewart et al. | |
| 2015/0308444 | A1 | 10/2015 | Trottman | |
| 2015/0330194 | A1 | 11/2015 | June et al. | |
| 2015/0354308 | A1 | 12/2015 | June et al. | |
| 2015/0354590 | A1 | 12/2015 | Kao | |
| 2015/0376907 | A1 | 12/2015 | Nguyen | |
| 2016/0010451 | A1 | 1/2016 | Melo | |
| 2016/0016834 | A1 | 1/2016 | Dahule | |
| 2016/0169231 | A1 | 6/2016 | Michelassi et al. | |
| 2016/0305447 | A1 | 10/2016 | Dreiss et al. | |
| 2016/0332856 | A1 | 11/2016 | Steedley | |
| 2017/0058664 | A1 | 3/2017 | Xiao et al. | |
| 2017/0074082 | A1 | 3/2017 | Palmer | |
| 2017/0122046 | A1 | 5/2017 | Vavik | |
| 2017/0138189 | A1 | 5/2017 | Ahmad et al. | |
| 2017/0159668 | A1 | 6/2017 | Nowitzki et al. | |
| 2017/0167498 | A1 | 6/2017 | Chang | |
| 2017/0175752 | A1 | 6/2017 | Hofer et al. | |
| 2017/0183942 | A1 | 6/2017 | Veland | |
| 2017/0194831 | A1 | 7/2017 | Marvel | |
| 2017/0292533 | A1 | 10/2017 | Zia | |
| 2017/0321695 | A1 | 11/2017 | Head | |
| 2017/0328151 | A1 | 11/2017 | Dillard | |
| 2018/0058157 | A1 | 3/2018 | Melo et al. | |
| 2018/0066671 | A1 | 3/2018 | Murugan | |
| 2018/0171763 | A1 | 6/2018 | Malbrel et al. | |
| 2018/0171767 | A1 | 6/2018 | Huynh et al. | |
| 2018/0172020 | A1 | 6/2018 | Ejim | |
| 2018/0223854 | A1 | 8/2018 | Brunvold et al. | |
| 2018/0226174 | A1 | 8/2018 | Rose | |
| 2018/0238152 | A1 | 8/2018 | Melo | |
| 2018/0306199 | A1 | 10/2018 | Reed | |
| 2018/0320059 | A1 | 11/2018 | Cox et al. | |
| 2018/0340389 | A1 | 11/2018 | Wang | |
| 2018/0363660 | A1 | 12/2018 | Klahn | |
| 2019/0032667 | A1 | 1/2019 | Ifrim et al. | |
| 2019/0040863 | A1 | 2/2019 | Davis et al. | |
| 2019/0234209 | A1 | 8/2019 | Ejim et al. | |
| 2019/0271217 | A1 | 9/2019 | Radov et al. | |
| 2019/0368291 | A1 | 12/2019 | Xiao et al. | |
| 2020/0056462 | A1 | 2/2020 | Xiao et al. | |
| 2020/0056615 | A1 | 2/2020 | Xiao et al. | |
| 2020/0248538 | A1 | 8/2020 | Xiao et al. | |
| 2020/0248695 | A1 | 8/2020 | Xiao et al. | |
| 2020/0355184 | A1 | 12/2020 | Xiao et al. | |
| 2021/0040826 | A1 | 2/2021 | Xiao et al. | |
| 2021/0140290 | A1* | 5/2021 | Eslinger | E21B 43/12 |

FOREIGN PATENT DOCUMENTS

| | | |
|---|---|---|
| CN | 2168104 | 6/1994 |
| CN | 1507531 | 6/2004 |
| CN | 101328769 | 12/2008 |
| CN | 101842547 | 9/2010 |
| CN | 202851445 | 4/2013 |
| CN | 103185025 | 7/2013 |
| CN | 203420906 | 2/2014 |
| CN | 104141633 | 11/2014 |
| CN | 104533797 | 4/2015 |
| CN | 103835988 | 1/2016 |
| CN | 105239963 | 1/2016 |
| CN | 103717901 | 6/2016 |
| DE | 2260678 | 6/1974 |
| DE | 3022241 | 12/1981 |
| DE | 3444859 | 6/1985 |
| DE | 3520884 | 1/1986 |
| DE | 19654092 | 7/1998 |
| DE | 10307887 | 10/2004 |
| DE | 102007005426 | 5/2008 |
| DE | 102008001607 | 11/2009 |
| DE | 102008054766 | 6/2010 |
| DE | 102012215023 | 1/2014 |
| DE | 102012022453 | 5/2014 |
| DE | 102013200450 | 7/2014 |
| DE | 102012205757 | 8/2014 |
| EP | 0579981 | 1/1994 |
| EP | 0637675 | 2/1995 |
| EP | 1101024 | 5/2001 |
| EP | 1143104 | 10/2001 |
| EP | 1270900 | 1/2003 |
| EP | 1369588 | 12/2003 |
| EP | 2801696 | 12/2014 |
| EP | 2893301 | 5/2018 |
| EP | 3527830 | 8/2019 |
| GB | 670206 | 4/1952 |
| GB | 2173034 | 10/1986 |
| GB | 2226776 | 7/1990 |
| GB | 2283035 | 4/1995 |
| GB | 2348674 | 10/2000 |
| GB | 2477909 | 8/2011 |
| GB | 2504104 | 1/2014 |
| JP | S 6189998 | 5/1986 |
| JP | S 62142894 | 6/1987 |
| JP | 4019375 | 1/1992 |
| JP | H 0443814 | 2/1992 |
| JP | H 09254894 | 9/1997 |
| JP | H 109196 | 1/1998 |
| JP | 2005076486 | 3/2005 |
| JP | 2013110910 | 6/2013 |
| JP | 2013245569 | 12/2013 |
| RU | 98500 | 10/2010 |
| RU | 122531 | 11/2012 |
| RU | 178531 | 4/2018 |
| WO | WO 1995004869 | 2/1995 |
| WO | WO 1998046857 | 10/1998 |
| WO | WO 1999027256 | 6/1999 |
| WO | WO 2002072998 | 9/2002 |
| WO | WO 2005066502 | 7/2005 |
| WO | WO 2009113894 | 9/2009 |
| WO | WO 2009129607 | 10/2009 |
| WO | WO 2011066050 | 6/2011 |
| WO | WO 2011101296 | 8/2011 |
| WO | WO 2011133620 | 10/2011 |
| WO | WO 2011135541 | 11/2011 |
| WO | WO 2012058290 | 5/2012 |
| WO | WO 2012166638 | 12/2012 |
| WO | WO 2013089746 | 6/2013 |
| WO | WO 2013171053 | 11/2013 |
| WO | WO 2014127035 | 8/2014 |
| WO | WO 2014147645 | 9/2014 |
| WO | WO 2015034482 | 3/2015 |
| WO | WO 2015041655 | 3/2015 |
| WO | WO 2015084926 | 6/2015 |
| WO | WO 2015123236 | 8/2015 |
| WO | WO 2016003662 | 1/2016 |
| WO | WO 2016012245 | 1/2016 |
| WO | WO 2016050301 | 4/2016 |

(56) References Cited

FOREIGN PATENT DOCUMENTS

| | | |
|---|---|---|
| WO | WO 2016081389 | 5/2016 |
| WO | WO 2016089526 | 6/2016 |
| WO | WO 2016160016 | 10/2016 |
| WO | WO 2016195643 | 12/2016 |
| WO | WO 2017021553 | 2/2017 |
| WO | WO 2018022198 | 2/2018 |
| WO | WO 2018096345 | 5/2018 |
| WO | WO 2019243789 | 12/2019 |

OTHER PUBLICATIONS

Alhanati et al., "ESP Failures: Can we talk the same language?" Society of Petroleum Engineers (SPE), SPE paper, SPE ESP Workshop held in Houston, Apr. 25-27, 2001, 11 page.

Alhasan et al., "Extending mature field production life using a multiphase twin screw pump," BHR Group Multiphase 15, 2011, 11 pages.

BakerHughes.com, [online], "Multiphase Pump: Increases Efficiency and Production in Wells with High Gas Content," Brochure overview, retrieved from URL <https://assets.www.bakerhughes.com/system/69/00d970d9dd11e3a411ddf3c1325ea6/28592.MVP_Overview.pdf>, 2014, 2 pages.

Blunt, "Effects of heterogeneity and wetting on relative permeability using pore level modeling," SPE 36762, Society of Petroleum Engineers (SPE), SPE Journal 2:01 (70-87), Mar. 1997, 19 pages.

Bryant and Blunt, "Prediction of relative permeability in simple porous media," Physical Review A 46:4, Aug. 1992, 8 pages.

Champion et al., "The application of high-power sound waves for wellbore cleaning," SPE 82197, Society of Petroleum Engineers International (SPE), presented at the SPE European Formation Damage Conference, May 13-14, 2003, 10 pages.

Chappell and Lancaster, "Comparison of methodological uncertainties within permeability measurements," Wiley InterScience, Hydrological Processes 21:18 (2504-2514), Jan. 2007, 11 pages.

Cramer et al., "Development and Application of a Downhole Chemical Injection Pump for Use in ESP Applications," SPE 14403, Society of Petroleum Engineers (SPE), presented at the 66th Annual Technical Conference and Exhibition, Sep. 22-25, 1985, 6 page.

Danfoss, "Facts Worth Knowing about Frequency Converters," Handbook VLT Frequency Converters, Danfoss Engineering Tomorrow, 180 pages.

DiCarlo et al., "Three-phase relative permeability of water-wet, oil-wet, and mixed-wet sandpacks," SPE 60767, Society of Petroleum Engineers (SPE), presented at the 1998 SPE Annual Technical Conference and Exhibition, Sep. 27-30, 1998, SPE Journal 5:01 (82-91), Mar. 2000, 10 pages.

Dixit et al., "A pore-level investigation of relative permeability hysteresis in water-wet systems," SPE 37233, Society of Petroleum Engineers (SPE), presented at the 1997 SPE International Symposium on Oilfield Chemistiy, Feb. 18-21, 1997, SPE Journal 3:02 (115-123), Jun. 1998, 9 pages.

Drozdov et al., "The Use of Umbilicals as a New Technology of Artificial-Lift Operation of Oil and Gas Wells without Well Killing when Workover," SPE 160689, Society of Petroleum Engineers, presented at the SPE Russian Oil & Gas Exploration & Production Technical Conference and Exhibition in Moscow, Russia, Oct. 16-18, 2012, 8 pages.

Ejprescott.com [online], "Water, Sewer and Drain Fittings B-22, Flange Adaptors," retrieved from URL <https://www.ejprescott.com/media/reference/FlangeAdaptorsB-22.pdf> retrieved on Jun. 15, 2020, available on or before Nov. 2010 via wayback machine URL <http://web.archive.org/web/20101128181255/https://www.ejprescott.com/media/reference/FlangeAdaptorsB-22,pdf>, 5 pages.

Fatt, "The network model of porous media," SPE 574-G, Society of Petroleum Engineers (SPE), I. Capillary Pressure Characteristics, AIME Petroleum Transactions 207: 144-181, Dec. 1956, 38 pages.

Geary et al., "Downhole Pressure Boosting in Natural Gas Wells: Results from Prototype Testing," SPE 11406, Society of Petroleum Engineers International (SPE), presented at the SPE Asia Pacific Oil and Gas Conference and Exhibition, Oct. 20-22, 2008, 13 pages.

Glossary.oilfield.slb.com [online], "Subsurface Safety Valve (SSSV)," available on or before Feb. 26, 2013, via Internet Archive: Wayback Machine URL <https://web.archive.org/web/20130226223723/https://www.glossary.oilfield.slb.com/en/Terms/s/subsurface_safety_valve_sssv.aspx>, retrieved on Dec. 1, 2020, URL <https://www.glossary.oilfield.slb.com/en/Terms/s/subsurface_safety_valve_sssv.aspx>, 2 pages.

Godbole et al., "Axial Thrust in Centrifugal Pumps—Experimental Analysis," Paper Ref: 2977, presented at the 15th International Conference on Experimental Mechanics, ICEM15, Jul. 22-27, 2012, 14 pages.

Heiba et al., "Percolation theory of two-phase relative permeability," Society of Petroleum Engineers (SPE), SPE Reservoir Engineering 7:01 (123-132), Febmaiy 1992, 11 pages.

Hua et al., "Comparison of Multiphase Pumping Techniques for Subsea and Downhole Applications," SPE 146784, Society of Petroleum Engineers International (SPE), presented at the SPE Annual Technical Conference and Exhibition, Oct. 30-Nov. 2, 2011, Oil and Gas Facilities, Feb. 2012, 11 pages.

Hui and Blunt, "Effects of wettability on three-phase flow in porous media" American Chemical Society (ACS), J. Phys. Chem. 104 :16 (3833-3845), Feb. 2000, 13 pages.

Hunting-intl.com [online], "Mechanical Centralizers and Decentralizers" Mar. 2015, [retrieved on Aug. 25, 2020], retrieved from: URL <http://www.hunting-intl.com/titan/wireline-hardware-and-accessories/mechanical-centralizers-and-decentralizers>, 1 page.

Krag et al., "Preventing Scale Deposition Downhole Using High Frequency Electromagnetic AC Signals from Surface Enhance Production Offshore Denmark," SPE-170898-MS, Society of Petroleum Engineers International (SPE), presented at the SPE Annual Technical Conference and Exhibition, Oct. 27-29, 2014, 10 pages.

Laserfocusworld.com [online], "High-Power Lasers: Fiber lasers drill for oil," Dec. 5, 2012, retrieved on May 31, 2018, retrieved from URL: <https://www.laserfocusworld.com/articles/print/volume-48/issue-12/world-news/high-power-lasers-fiber-lasers-drill-for-oil.html>, 4 pages.

Li et al., "In Situ Estimation of Relative Permeability from Resistivity Measurements," EAGE/The Geological Society of London, Petroleum Geoscience 20: 143-151, 2014, 10 pages.

Machinedesign.com [online], Frances Richards, "Motors for efficiency: Permanent-magnet, reluctance, and induction motors compared," Apr. 2013, retrieved on Nov. 11, 2020, retrieved from URL <https://www.machinedesign.com/motors-drives/article/21832406/motors-for-efficiency-permanentmagnet-reluctance-and-induction-motors-compared>.

Mahmud et al., "Effect of network topology on two-phase imbibition relative permeability," Transport in Porous Media 66:3 (481-493), Feb. 2007, 14 pages.

Mirza, "The Next Generation of Progressive Cavity Multiphase Pumps use a Novel Design Concept for Superior Performance and Wet Gas Compression," Flow Loop Testing, BHR Group, 2007, 9 pages.

Mirza, "Three Generations of Multiphase Progressive Cavity Pumping," Cahaba Media Group, Upstream Pumping Solutions, Winter 2012, 6 pages.

Muswar et al., "Physical Water Treatment in the Oil Field Results from Indonesia," SPE 113526, Society of Petroleum Engineers International (SPE), presented at the SPE Asia Pacific Oil and Gas Conference and Exhibition, Oct. 18-20, 2010, 11 pages.

Nagy et al., "Comparison of permeability testing methods," Proceedings of the 18th International Conference on Soil Mechanics and Geotechnical Engineering 399-402, 2013, 4 pages.

Parker, "About Gerotors," Parker Haffinfin Corp, 2008, 2 pages.

Purcell, "Capillary pressures—their measurement using mercury and the calculation of permeability therefrom," Petroleum Transactions, AIME, presented at the Branch Fall Meeting, Oct. 4-6, 1948, Journal of Petroleum Technology 1:02 (39-48), Feb. 1949, 10 pages.

Rzeznik et al., "Two Year Results of a Breakthrough Physical Water Treating System for the Control of Scale in Oilfield Applications,"

(56) References Cited

OTHER PUBLICATIONS

SPE114072, Society of Petroleum Engineers International (SPE), presented at the 2008 SPE International Oilfield Scale Conference, May 28-29, 2008, 11 pages.
Schöneberg, "Wet Gas Compression with Twin Screw Pumps," Bomemann Pumps, Calgary Pump Symposium 2005, 50 pages.
Simpson et al., "A Touch, Truly Multiphase Downhole Pump for Unconventional Wells," SPE-185152-MS, Society of Petroleum Engineers (SPE), presented at the SPE Electric Submersible Pump Symposium, the Woodlands, Texas, Apr. 24-28, 2017, 20 pages.
Slb.com [online], "AGH: Advanced Gas-Handling Device," Product Sheet, retrieved from URL: <http://www.slb.com/~/media/Files/artificial_lift/product_sheets/ESPs/advanced_gas_handling_ps.pdf>, Jan. 2014, 2 pages.
Sulzer Technical Review, "Pushing the Boundaries of Centrifugal Pump Design," Oil and Gas, Jan. 2014, 2 pages.
Tm4.com [online], "Outer rotor for greater performance," available on or before Dec. 5, 2017, via internet archive: Wayback Machine URL <https://web.archive.org/web/20171205163856/https://www.tm4.com/technology/electric-motors/external-rotor-motor-technology/>, retrieved on May 17, 2017, retrieved from URL <https://www.tm4.com/technology/electric-motors/extemal-rotor-motor-technology/>, 2 pages.
Wylde et al., "Deep Downhole Chemical Injection on BP-Operated Miller: Experience and Learning," SPE 92832, Society of Petroleum Engineers (SPE), presented at the 2005 SPE International Symposium on Oilfield Chemistry, May 11-12, 2005, SPE Production & Operations, May 2006, 6 pages.
Xiao et al., "Induction Versus Permanent Magnet Motors for ESP Applications," SPE-192177-MS, Society of Petroleum Engineers (SPE), presented at the SPE Kingdom of Saudi Arabia Annual Technical Symposium and Exhibition, Apr. 23-26, 2018, 15 pages.
Zhan et al., "Characterization of Reservoir Heterogeneity Through Fluid Movement Monitoring with Deep Electromagnetic and Pressure Measurements," SPE 116328, Society of Petroleum Engineers International (SPE), presented at the 2008 SPE Annual Technical Conference and Exhibition, Sep. 21-24, 2008, 16 pages.

* cited by examiner

WELLBORE DENSITY METER USING A ROTOR AND DIFFUSER

TECHNICAL FIELD

This disclosure relates to measuring properties of fluids flowing through a wellbore.

BACKGROUND

In hydrocarbon production, a producing well can produce both hydrocarbons and water. Knowing the ratio of water to hydrocarbons is important for determining a quantity of hydrocarbons a well produces, as well as running flow assurance calculations. Two types of measurement tools used to determine a downhole water content of a production flow are based on technology found in a gamma ray densitometer and a gradiomanometer. The gamma ray tool is based on the principle that the absorbance of gamma rays is inversely proportional to the density of the medium through which the gamma rays pass. Such a tool include a gamma ray source, a channel through which the fluid medium can flow through, and a gamma ray detector. The gradiomanometer is a device used to determine average fluid density by measuring the pressure difference between two pressure sensors. The pressure sensors are typically spaced (axially) about 0.6 m (2 feet) from each other.

In some instances, an electric submersible pump can be installed within a completed well to increase production rates.

SUMMARY

This disclosure describes technologies relating to measuring fluid density in a fluid flow, for example, a fluid flow through a well bore.

In certain aspects, an electric submersible pump (ESP) assembly measures a density of a fluid in a wellbore. The ESP assembly includes a fluid entrance, and a density meter rotationally connected to a motor via the shaft and fluidly connected to the fluid entrance. The density meter has a diffuser with an interior volume defined by an inner surface, and has a rotor arranged in the interior volume of the diffuser rotationally coupled to the motor via the shaft. The rotor includes an interior wall, a partition having a first face and a second face opposite the first face, and a rotor channel defined by the first face of the partition of the rotor and the interior wall of the rotor. The rotor channel extends from an inlet to an outlet. The inlet is fluidly connected to the fluid entrance of the ESP assembly and is arranged at a first radial distance from the axis. The outlet is arranged at a second radial distance from the axis, and the first radial distance of the inlet is less than the second radial distance of the outlet. The density meter also includes a sensor sub-assembly and a measurement channel defined by the inner surface of the diffuser and the second face of the partition of the rotor. The measurement channel extends from the outlet of the rotor channel to the inlet of the rotor channel. The sensor sub-assembly is arranged on the inner surface of the diffuser and is configured to measure at least two pressures in the measurement channel.

In some cases, the measurement channel is configured to flow fluid from the rotor channel.

Some measurement channels are arranged adjacent to the rotor channel. In some cases, the sensor sub-assembly includes a first pressure sensor arranged in the measurement channel at a first radial distance from the axis. The sensor sub-assembly can also include a second pressure sensor arranged in the measurement channel at a second radial distance from the axis. The first radial distance of the first pressure sensor is greater than the second radial distance of the second pressure sensor. The first radial distance of the first pressure sensor may be known and/or the second radial distance of the second pressure sensor may be known.

Some ESP assemblies further include one or more processors; and a computer-readable medium storing instructions executable by the one or more processors to perform operation. The operations can include prompting the motor to rotate the rotor of the ESP assembly about the axis such that the fluid at the outlet of the rotor channel of the rotor is at a higher fluid pressure than the inlet of the rotor channel. The inlet of the rotor channel is arranged radially closer to the axis than the outlet of the rotor channel. The operations also include prompting a first pressure sensor disposed in a measurement channel defined between the rotor and a diffuser to read or measure a first pressure signal and prompting a second pressure sensor disposed in the measurement channel to read or measure a second pressure signal, wherein the second pressure sensor is arranged downstream of the first pressure sensor and the second pressure sensor is arranged radially closer to the axis than the first pressure sensor.

In some embodiments, the operations further includes determining the density of the fluid in the measurement channel based on the first pressure signal and the second pressure signal.

Some ESP assemblies further include a pump configured to convey fluid in a first direction from the inlet on the rotor channel to the outlet of the rotor channel. In some cases, the fluid flowing in the measurement channel flows in a second direction, opposite the first direction.

The first radial distance of the inlet of the rotor channel and/or the second radial distance of the outlet of the rotor channel may be known.

Some diffuser channels are defined by the inner surface if the diffuser is fluidly connected to the outlet of the rotor channel and the fluid entrance of the ESP assembly. In some cases, the diffuser channel is arranged downstream of the rotor channel.

In some cases, the rotor is rotatable relative to the diffuser.

In some cases, the fluid is an oil-water mixture.

In some embodiments, a total volume of the measurement channel is less than the total volume of the rotor channel. The total volume of the measurement channel can be about 1% to about 20% of the total volume of the rotor channel.

In some cases, the ESP assembly further includes a pump configured to convey the fluid from the first end of the ESP assembly to the second end of the ESP assembly, wherein the pump is arranged upstream of the density meter.

In some ESP assemblies, the density meter forms an intake portion of the pump.

In certain aspects, a method to determine the density of a fluid flowing in an electric submersible pump assembly, includes rotating a shaft, by a motor, at a predetermined angular velocity such that a rotor of the ESP, rotationally coupled to the shaft, rotates about an axis relative to a diffuser of the ESP assembly. The rotor defines a rotor channel. The method further includes sensing, by a first pressure sensor, a first pressure indicative of the pressure at a first location in a measurement channel. The first location is at a first radial distance from the axis. The method also includes sensing, by a second pressure sensor, a second pressure indicative of the pressure at a second location in a measurement channel. The second location is at a second radial distance from the axis. The first radial distance is larger than the second radial distance.

Some methods also include determining the density of the fluid based on the first and second pressures, the first radial distance, the second radial distance, and a predetermined angular velocity of the shaft.

In some cases, the density is determined using the equation:

$$\rho = \frac{2(p_1 - p_2)}{\bar{k}^2\Omega^2(d_1^2 - d_2^2)}.$$

In some embodiments, the method also includes determining a water cut of the fluid. The water cut can be determined based on the determined density of the fluid, a predetermined density of water, and a predetermined density of oil. The water-cut can be determined using the equation:

$$WC = \frac{\rho - \rho_o}{\rho_w - \rho_o}.$$

In some methods, the fluid is an oil-water mixture.

The details of one or more embodiments of the invention are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Production of oil-water mixtures is very common in oilfield operations. One of the physical properties of the fluid mixture required by production engineers, reservoir engineers, or the field operators is the water-cut of the produced fluid downhole. Water-cut is the ratio of water volume flow rate to the oil-water (mixture) volume flow rate. To determine the production water-cut, accurate knowledge of the downhole oil-water mixture density is useful.

This disclosure describes an apparatus and method for measuring the density of oil-water mixtures and determining an oil-to-water ratio during production operations either downhole or topside. The disclosed ESP assembly includes a density meter with a main (first) channel and a measurement channel. The first channel is arranged in a rotatable rotor and has an inlet and an outlet through which fluid flows uphole from the inlet to the outlet. The channel is shaped so that, when the rotor rotates, the fluid at the outlet experiences a higher pressure than the fluid at the inlet, specifically due to centrifugal forces. The measurement channel fluidly connects to the first channel at the inlet and the outlet. Due to the high pressure at the outlet of the channel, a small portion of fluid leaks from the channel into the measurement channel. The fluid in the measurement channel moves from the outlet of the channel to the inlet of the channel due to the pressure difference between the inlet of the channel and the outlet of the channel. A first pressure sensor and a second pressure sensor are arranged at known locations in the measurement channel. The difference between the pressures measured by the pressure sensors can be used to calculate the density of the fluid flowing in the measurement channel, and therefore, the density of the fluid flowing in the ESP assembly.

This compressed configuration of the measurement channel does not increase the length of the ESP assembly, thereby reducing the risk of bending and reducing installation time. Further, the density meter can be used in any well orientation and can be used at the surface to determine a density of a fluid. In addition, the density measurement is not restricted by or tied to the flow rate of the fluid. The disclosed density meter is compact and, during operation, does not constitute a health, safety, security, or environmental concern.

Figure 1:
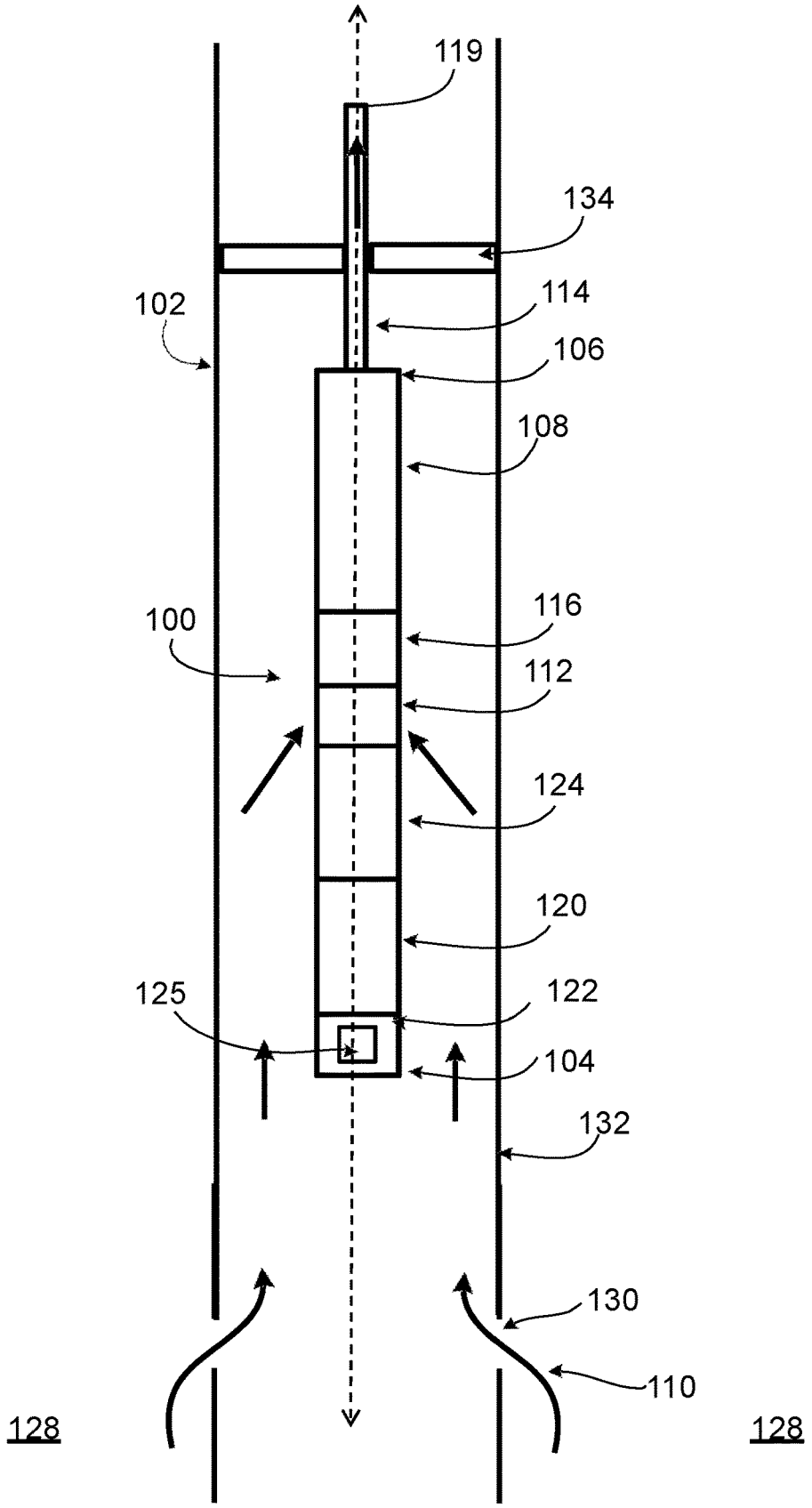
FIG. 1 is a cross-section view of an electric submersible pump (ESP) assembly arranged in a wellbore.

FIG. 1 is a cross-section view of an electric submersible pump assembly 100 arranged in a wellbore 102. The ESP assembly 100 measures a density of a fluid 110, e.g., an oil and water mixture, from the wellbore 102 that enters the ESP assembly 100. The ESP assembly 100 has a first (downhole) end 104 and a second (uphole) end 106. The downhole end 104 is closer to a bottom of the well, whereas the uphole end is closer to the surface. A pump 108 conveys fluid 110 from the downhole end 104 to the uphole end 106 of the ESP assembly 100. The fluid 110 enters the ESP assembly at a fluid entrance 112 of the ESP assembly and flows from the fluid entrance 112, to the surface via the production tubing 114. The fluid entrance 112 and the production tubing 114 are connected by channels (not shown) in a density meter 116 and the pump 108. In some ESP assemblies, the density meter 116 is integrally formed with the pump 108, for example, forming an intake portion of the pump. The ESP assembly further includes a shaft 118 (FIG. 2A) on which the density meter 116 is mounted. The shaft (not shown) is rotationally connected to a motor 120 operable to rotate the shaft about an axis 119. A monitoring sub-system 122 of the ESP assembly is mounted on the motor 120. A protector 124 of the ESP assembly 100 is mounted to the shaft. In such a configuration, the shaft axially connects the motor 120, the protector 124, the density meter 116, and the pump 108. A housing (not shown) axially connects the ESP sub assembly. The monitoring sub-system 122 includes a processor 125 electrically connected to the motor 120. In some cases, the processor controls the motor. In some cases, the motor is controlled by a driver.

The monitoring sub-system 122 contains sensors that measure pump intake, intake pressures, discharge pressures, motor oil, winding temperature, and winding vibrations. The data sensed by the sensors of the monitoring subsystem can be transmitted to the surface via a power cable and/or via the processor 125. The processor 125 can sort, compile, compute, and analyze the sensed data prior to transmitting the data to the surface. In other systems, the sensed data may be sent to the surface, where it is sorted, complied, computed, and analyzed. Some processors can control the motor. In some systems, the motor is controlled by a variable frequency driver at the surface.

The pump 108, density meter 116, motor 120, protector 124 and monitoring sub-system 122 are axially attached to each other and are each positionally maintained by an exterior housing. The fluid 110 enters the wellbore 102 from a formation 128 via a perforation 130 in a wellbore casing 132. A packer 134, attached to the production tubing 114 fluidic ally isolates the wellbore so that the fluid 110 from the formation enters the fluid entrance 112. The fluid 110 then moves from the fluid entrance 112 to the density meter 116, arranged upstream of the pump 108 so that the pump 108 provides a primary suction force, pulling the fluid 110 uphole from the fluid entrance 112 to the density meter 116. The density meter 116 measures a pressure differential in a measurement channel (not shown), to determine a density of the fluid 110.

Figure 2A:
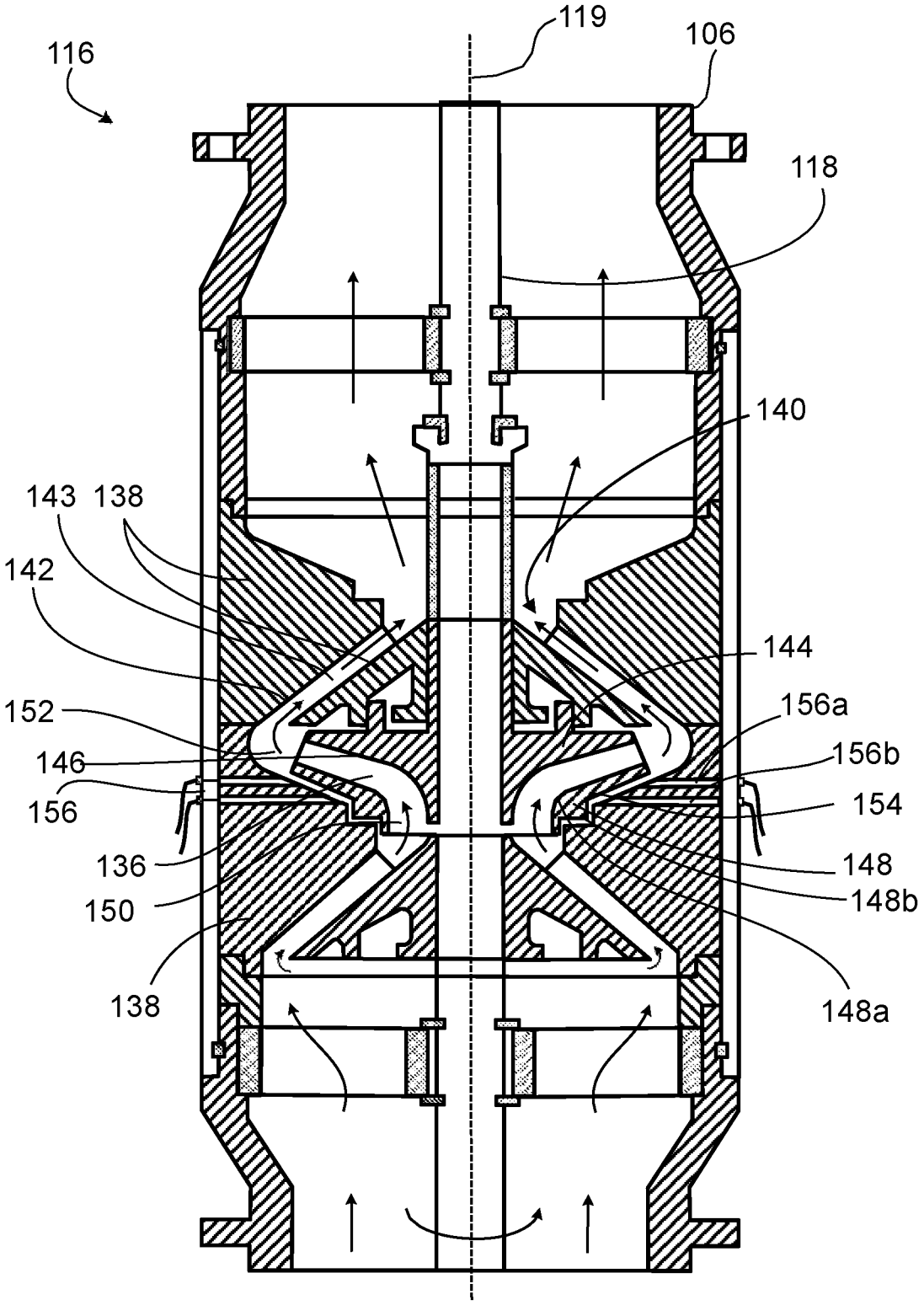
FIGS. 2A and 2B are cross-sectional views of a density meter of the ESP assembly.
Figure 2B:
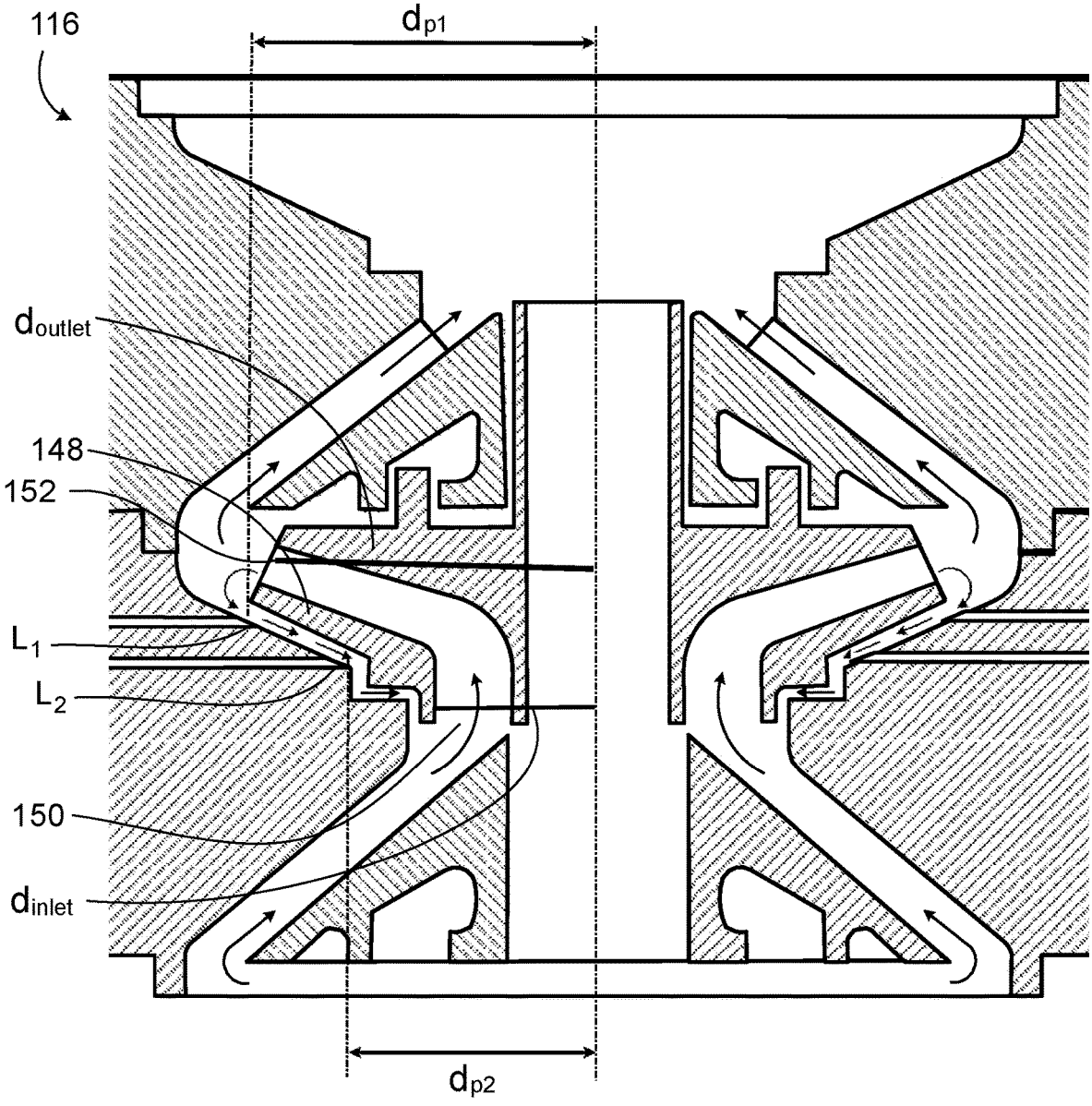

FIGS. 2A and 2B are cross-sectional views of a density meter 116 of the ESP assembly 100. The density meter is fluidly connected to the fluid entrance so that fluid 110 entering the ESP assembly 100 flows through a first channel 136 of the density meter 116. The density meter 116 includes a diffuser 138 having an interior volume 140 defined by an inner surface 142 and a diffuser channel 143 fluidically connected to the first channel 136 and the pump 108. The diffuser 138 of the density meter 116 is rotationally decoupled from the motor 120 and from the shaft 118. The density meter 116 also includes a rotor 144 arranged in the interior volume 140 of the diffuser 138 and rotationally coupled to the motor 120 via a shaft 118.

The rotor 144 includes an interior wall 146 and a partition 148 have a first face 148*a* and a second face 148*b*, opposite the first face 148*a*. The partition may be a plate or baffle. The size and dimensions of the plate or baffle may increase as the rotor size increases. The rotor 144 defines the first channel 136 by the first face 148*a* of the partition 148 of the rotor 144 and the interior wall 146 of the rotor 144. The first face 148*a* is curved so that the first channel 136 extends radially outward from the axis 119. The second face 148*b* can be curves or can include steps. The first channel 136 extends from an inlet 150 to an outlet 152. The inlet 150 is fluidly connected to the fluid entrance 112 of the ESP assembly 100 and is arranged at a known first radial distance $d_{inlet}$ from the axis 119. The outlet 152 is arranged at a known second radial distance $d_{outlet}$ from the axis 119 and fluidically connects to the diffuser channel 143. The first radial distance $d_{inlet}$ of the inlet 150 is less than the second radial distance $d_{outlet}$ of the outlet 152.

The interior wall 146 of the rotor 144 attaches to the shaft 118 so that the rotor 144, including the partition 148 and the interior wall 146 rotate at the same revolutions per minute (RPM) or angular velocity (Ω) as the shaft 118. The angular velocity (or RPM) of the rotor 144 is therefore known as the motor 120 can be programed or prompted to rotate at a predetermined angular velocity or RPM.

In this configuration, when the rotor 144 is rotating under the force of the motor 120, the fluid 110 flowing in the first channel pressurizes. Due to the outlet 152 being arranged farther from the axis 119 than the inlet 150, the centrifugal forces on the fluid 110 at the outlet 152 are larger than the centrifugal forces on the fluid 110 at the inlet 150. Therefore, when the rotor 144 is rotating, the fluid at the outlet 152 is at a higher pressure than the fluid at the inlet 150. This centrifugal force also contributes to the suction force of the pump 108 to move the fluid from the inlet 150 to the outlet 152. Despite pressure difference of the outlet and the inlet (downhole), the pump 108 and rotor 144 provide sufficient conveyance force to move the fluid 110 through the first channel 136 in a first direction, (uphole) towards the surface.

The density meter 116 further includes a measurement channel 154 on which a sensor sub-assembly 156 is mounted. The measurement channel 154 is defined by the inner surface 142 of the diffuser 138 and a second face 148*b* of the partition 148 of the rotor 144. The measurement channel 154 extends from the outlet 152 of the first channel 136 to the inlet 150 of the first channel 136. The sensor sub-assembly 156 is electronically and/or electrically connected to the monitoring sub-system 122, for example, the processor 125. The sensor sub-assembly 156 of the density meter 116 includes a first pressure sensor 156*a* and a second pressure sensor 156*b*. The first pressure sensor 156*a* is arranged in the measurement channel 154 at known first radial distance $d_{p1}$ from the axis 119 and the second pressure sensor 156*b* is arranged in the measurement channel 154 at a known second radial distance $d_{p2}$ from the axis 119. The first radial distance $d_{p1}$ of the first pressure sensor 156*a* is greater than the second radial distance $d_{p2}$ of the second pressure sensor 156*b*. The first pressure sensor is configured to transmit first pressure signals to the monitoring sub-system 122 and/or processor 125 indicative of the pressure measured at the first radial distance $d_{p1}$. The second pressure sensor is configured to transmit second pressure signals to the monitoring sub-system 122 and/or processor 125 indicative of the pressure measured at the second radial distance $d_{p2}$.

While the pump 108 conveys the fluid from the inlet 150 of the first channel 136 to the outlet 152 of the first channel, the pressure differences between the inlet 150 and the outlet 152 cause a small portion of the fluid 110 to leak or enter into the measurement channel 154 at the outlet 152 of the first channel 136 and flow in a second direction from the outlet 152 (high pressure) to the inlet 150 (low pressure). At the inlet 150, the leaked or diverted fluid can re-enter the fluid 110 flowing in the first channel 136. In some cases the second direction is opposite the first direction. In some cases, the average directional vector of the first channel is opposite the average directional vector of the measurement channel. A total volume of the measurement channel is less than the total volume of the first channel so that only a portion of the fluid flowing in the first channel 136 is redirected to the measurement channel. In some cases, about 1% to about 25% of the volume of the fluid flowing in the first channel is diverted into the measurement channel. In some density channels, 1% to 15% (e.g., 2%, 5%, 7%, or 10%). In some cases, 1% to 5% of the volume of fluid in the first channel is diverted into the measuring channel.

The first pressure sensor 156*a* measures the pressure of the leaked fluid in the measurement channel 154 at a first location $L_1$ and the second pressure sensor 156*b* measures the pressure of the leaked fluid in the measurement channel 154 at a second location $L_2$ downstream of the first location $L_1$ and the first pressure sensor 156*a*. The distances between the axis 119, about which the shaft 118 and the rotor 144 rotate, and the first and second locations $L_1$, $L_2$ are known and can be used to calculate the density of the fluid.

The processor 125 can be located either downhole or at a topside facility. The processor 125 includes one or more processors and non-transitory memory storing computer instructions executable by the one or more processors to perform operations, for example, the operations to determine density. Alternatively, or in addition, the processor 125 can be implemented as processing circuitry, including electrical or electronic components (or both), configured to perform the operations described here. The processor 125 is configured to determine a density of the fluid flow using the following equation:

$$\rho = \frac{2(p_1 - p_2)}{k^2\Omega^2(d_1^2 - d_2^2)} \quad \text{(Eq. 1)}$$

wherein $p_1$ is the pressure measured by the first pressure sensor at the first location $L_1$, $p_2$ is the pressure measured by the second pressure sensor 156*b* at the second location $L_2$, $d_1$ is the radial distance between the axis 119 and the first location $L_1$, $d_2$ is the radial distance between the axis 119 and the second location $L_2$, $\Omega$ is the angular velocity of the rotor, and k is a known constant, and $\rho$ is a density of the fluid flow. Once density of the fluid flow is determined, then, the processor 125 can also determine a water-cut using the following equation:

$$WC = \frac{\rho - \rho_o}{\rho_w - \rho_o} \quad \text{(Eq. 2)}$$

where $\rho_o$ is a density of an oil portion of the fluid flow, $\rho_w$ is a water density of the fluid flow, and WC is the water-cut. The oil density variation with temperature and pressure would have been obtained with pressure-volume-temperature (PVT) analysis on the hydrocarbon obtained in the early life of the well. In the operation of the ESP assembly 100, the downhole pressure and temperature can be obtained from the monitoring sub-system 122. Based on the temperature and pressure, the density of the pure oil can be determined and can be used in Equation 2. Density of water can be determined by the processor 125 based on the pressure and temperature of the fluid flowing through the ESP assembly 100. The processor 125 is configured to execute a computer-readable medium storing instructions to perform operations or methods. The executable method includes prompting a pump of an electric submersible pump assembly to pump fluid from a first end to a second end of the ESP assembly, prompting a motor to rotate a rotor of the ESP assembly about an axis such that the fluid at an outlet of a first channel of the rotor is at a higher fluid pressure than the inlet of the first channel, wherein inlet of the first channel is arranged radially closer to the axis than the outlet of the first channel, prompting a first pressure sensor in a measurement channel defined between the rotor and a diffuser to measure a first pressure, wherein the measurement channel extends from the outlet of the first channel to the inlet of the first channel, and prompting a second pressure in the measurement channel to measure a second pressure, wherein the second pressure sensor is arranged downstream of the first pressure sensor and the second pressure sensor is arranged radially closer to the axis than the first pressure sensor. In some cases, the executable method further comprises determining the density of the fluid in the measurement channel based on the first pressure signal and the second pressure signal. The motor can be prompted to rotate by a processor or by a driver at the surface. The driver may be a fixed driver or a variable frequency driver.

Figure 3:
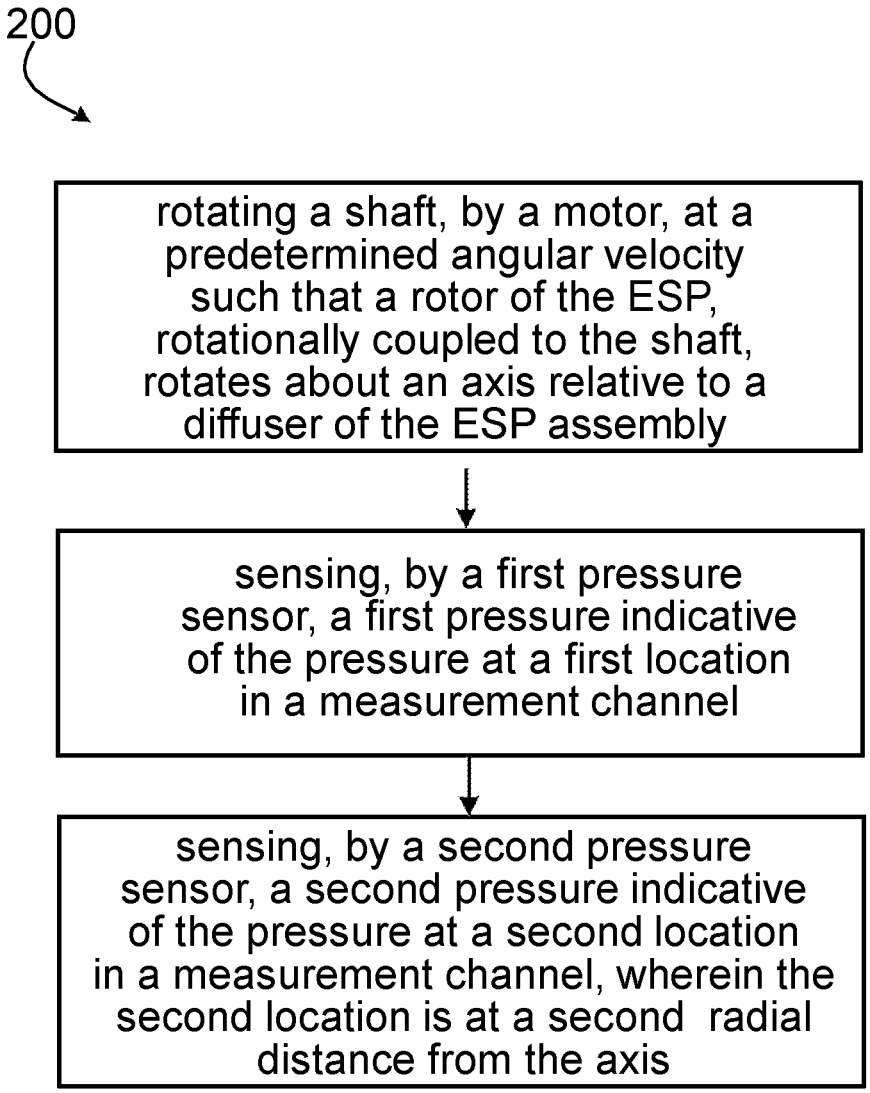
FIG. 3 is a flowchart of a method to determine the density of a fluid flowing in an ESP assembly.

FIG. 3 is a flowchart of a method 200 to determine the density of a fluid flowing in an ESP assembly. The method 200 is described with reference to the ESP assembly 100, however, the method may be applied to any applicable system, device, or arrangement. The method 200 for determining the density of the fluid 110 flowing in the electric submersible pump assembly 100 includes prompting, by the processor 125 (e.g., by the processor), the pump 108 to convey fluid from the fluid entrance 112 to the surface and prompting, by the processor 125 or by a driver (not shown) at the surface, the motor 120 to rotate the shaft 118 at a predetermined angular velocity such that the rotor 144 rotates about the axis 119 relative to the diffuser 138 of the ESP assembly 100. The driver may be part of the motor or may be separate from the motor. The rotation on the rotor 144 pressurizes the fluid 110 in the first channel 136. Due to the centrifugal forces, the fluid pressure at the outlet 152 of the first channel 136 is greater than the fluid pressure at the inlet 150 of the first channel because the outlet 152 is arranged radially farther from the rotational axis 119 than the inlet 150.

A majority of the fluid 110 continues to flow from the outlet 152 of the first channel 136 into the diffuser channel under the suction force of the pump 108, however, a portion of the fluid is diverted at the outlet 152 into the measurement channel due to the pressure drop from the outlet 152 to the inlet 150. The portion of fluid diverted into the measurement channel may be 1% to 5% (e.g., 1% to 30%) of the fluid flowing in the first channel 136.

The method 200 further includes measuring the first pressure at the first location $L_1$ by prompting the first pressure sensor 156*a* to measure or read a first pressure. The first pressure is indicative of the pressure at the first location $L_1$ in a measurement channel 154. The first location $L_1$ is at a first radial distance $d_{p1}$ from the axis 119 about which the rotor 144 and shaft 118 rotate. Next, the second pressure at the second location $L_2$ is measured by prompting the second pressure sensor 156*b* to measure or read a second pressure. The second pressure is indicative of the pressure at the second location $L_2$ in the measurement channel 154. The second location $L_2$ is at a second radial distance $d_{p2}$ from the axis 119 about which the rotor 144 and shaft 118 rotate. In the density meter 116, the first radial distance $d_{p1}$ is larger than the second radial distance $d_{p2}$, however, in some cases, the first radial distance may be less than the second radial distance. In some cases, the sensor sub-assembly includes a pressure differential sensor that determines the differential pressure between the first location of the measurement channel and the second location of the measurement channel.

After the first and second pressures, or the differential pressure, has been measured, the processor 125 determines the density of the fluid 110 using the first and second pressure signals, the first radial distance, the second radial distance, and a predetermined angular velocity of the shaft. The density can be determined using Equation 1. The processor 125 can also determine a water-cut of the fluid 110 based on the determined density of the fluid, a predetermined density of water and a predetermined density of oil. The water-cut can be determined using Equation 2.

A number of embodiments of the ESP assembly have been described. Nevertheless, it will be understood that various modifications may be made without departing from the spirit and scope of the invention. For example, some pumps and density meter may be arranged in different axial positions relative to the protector 124, the motor 120, and the monitoring sub-system 122.

Figure 4:
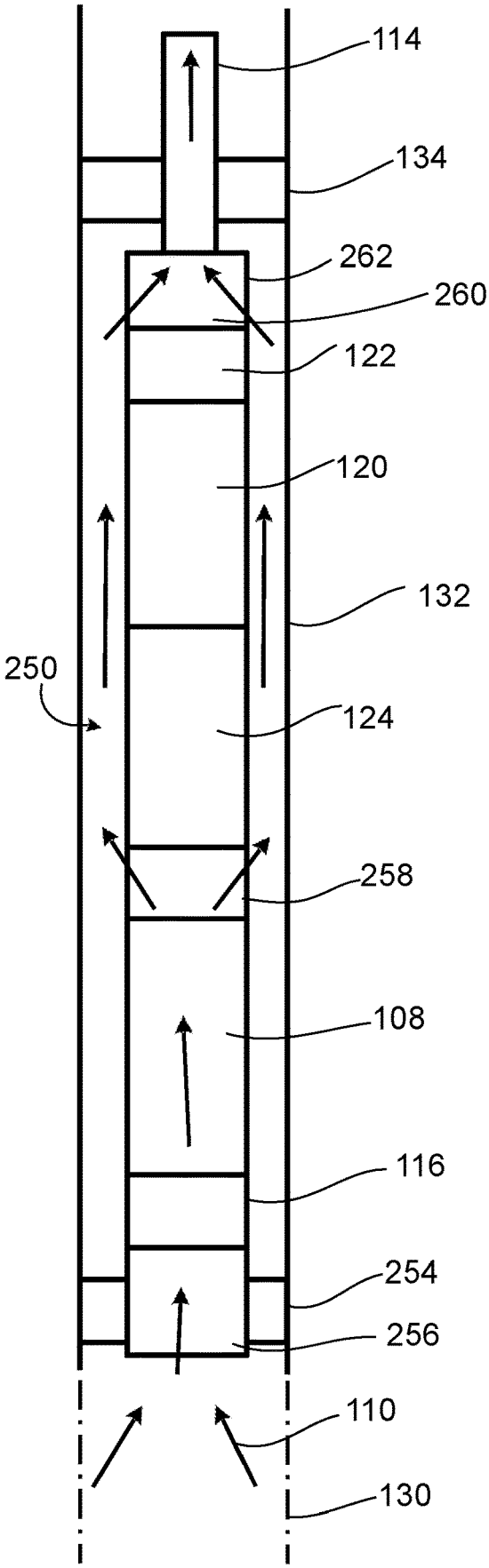
FIG. 4 is a cross-sectional view of an electric submersible pump assembly arranged in a wellbore.

FIG. 4 is a cross-sectional view of an electric submersible pump assembly 250 arranged in a wellbore 102. The ESP assembly 250 is substantially similar to the ESP assembly 100, however, the pump 108 and density meter 116 are arranged axially downhole from the protector 124, the, and the monitoring sub-system 122, in an inverted pump configuration. The ESP assembly 250 further includes a second packer 254, a first fluid entrance 256 (stinger), a fluid discharge 258, a second fluid entrance 260 uphole from the first fluid entrance 256 and a perforated flow coupling 262.

The second packer 254 isolates a portion of the wellbore below the (first) packer 134 and above the second packer 254. In this inverted pump configuration, the ESP assembly 250 can be deployed using a tubing deployment system in which the assembly is suspended from the flow coupling 262 by a production tubing. This configuration improves access to the motor 120. In the inverted configuration a packer 254 is used to prevent recirculation of high pressure fluid from the discharge 258 to the other (low pressure) side of the entrance 256.

In use, the fluid 110 downhole of the second packer 254 enters the first fluid entrance 256. The fluid 110 then flows through the density meter 116 and the pump 108 and exits the ESP assembly via the fluid discharge 258. The density of the fluid can be calculated as previously described with reference to FIGS. 2A, 2B and 3. The fluid 110, downstream of the first packer 134 and upstream of the second packer 254, then reenters the ESP assembly 250 by the second fluid entrance 260 and flows from the second fluid entrance 210 to the surface via the production tubing 114.

Figure 5:
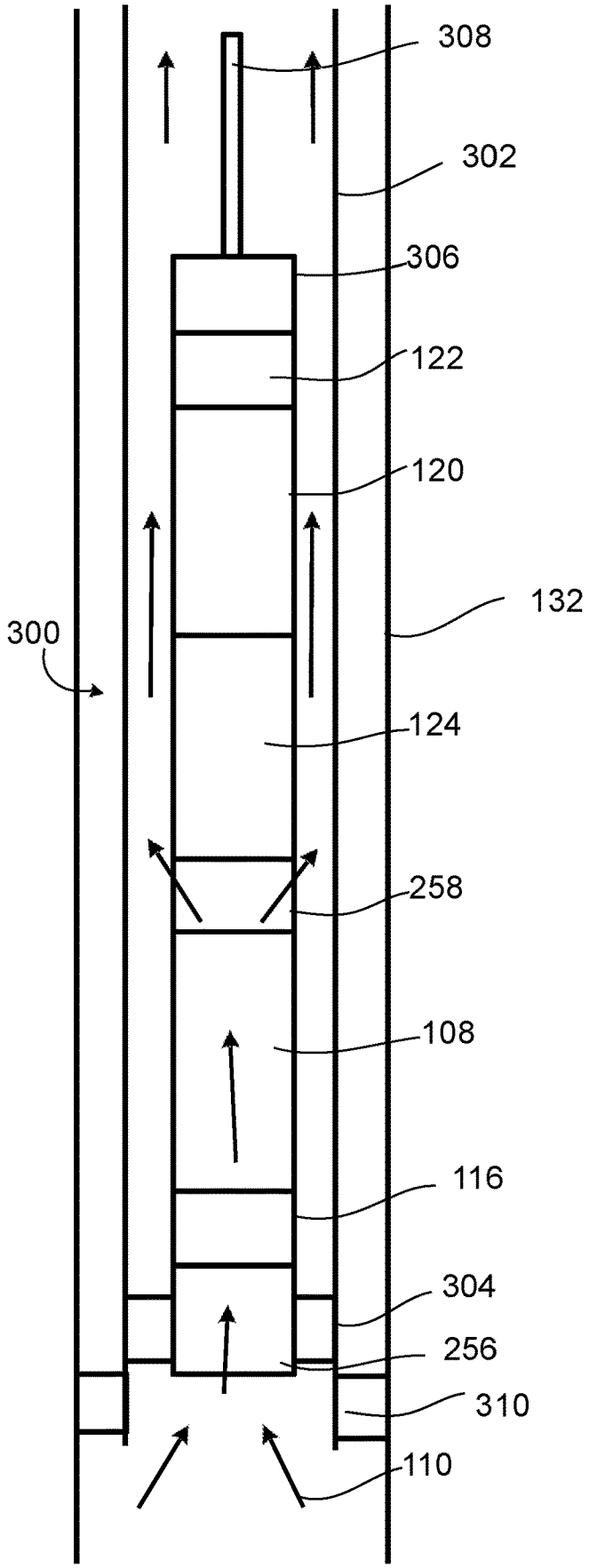
FIG. 5 is a cross-sectional view of an electric submersible pump assembly arranged in a wellbore.

FIG. 5 is a cross-sectional view of an electric submersible pump assembly 300 arranged in a wellbore 102. The ESP assembly 300 is substantially similar to the ESP assembly 100, however, ESP assembly 300 is a cable deployed ESP assembly 300 in an inverted configuration and the ESP assembly 300 is arranged in a production tubing 302. In the inverted configuration, the pump 108, and density meter 116 are arranged axially downhole from the protector 124, motor 120, and the monitoring sub-system 122. The ESP assembly 300 further includes a tubing packer 304, a fluid entrance 256 (stinger), a fluid discharge 258, and a cable adapter 306. The cable adapter 306 is connected to a power cable 308 that extends from the ESP assembly 300 to the surface. The tubing packer 304 isolates a portion of the wellbore below the (fluid entrance 256) within the production tubing 302. A casing packer 310 is arranged between the production tubing 302 and the casing 132. The casing packer 310 seals the casing 132 so that fluid flowing from the formation enters the ESP assembly 300, not the annular space between the production tubing 302 and the casing 132. In this pump configuration, the ESP assembly 300 can be deployed using a cable deployment system in which the assembly is suspended by the power cable. In this configuration, fluid flows uphole through the production tubing 302 and can prevent damage to the structural integrity, for example formations of pinhole leaks, of the casing 132. This configuration can be used with reservoir fluid that contains corrosive gases, for example such as H2S, which can be damaging to the structural integrity of the casing 132 over a long period of time. In addition, cable deployed ESP assemblies can reduce installation time and can reduce retrieval time of the ESP assemblies as compared to tubing-deployed ESP assemblies, thereby increasing equipment uptime and reducing costs.

In use, the fluid 110 downhole of the tubing packer 304 and the casing packer 310 enters the fluid entrance 256. The fluid 110 then flows through the density meter 116 and the pump 108 and exits the ESP assembly via the fluid discharge 258. The density of the fluid can be calculated as previously described with reference to FIGS. 2A, 2B and 3. The fluid 110, then continues to flow towards the surface in the production tubing 302.

Figure 6:
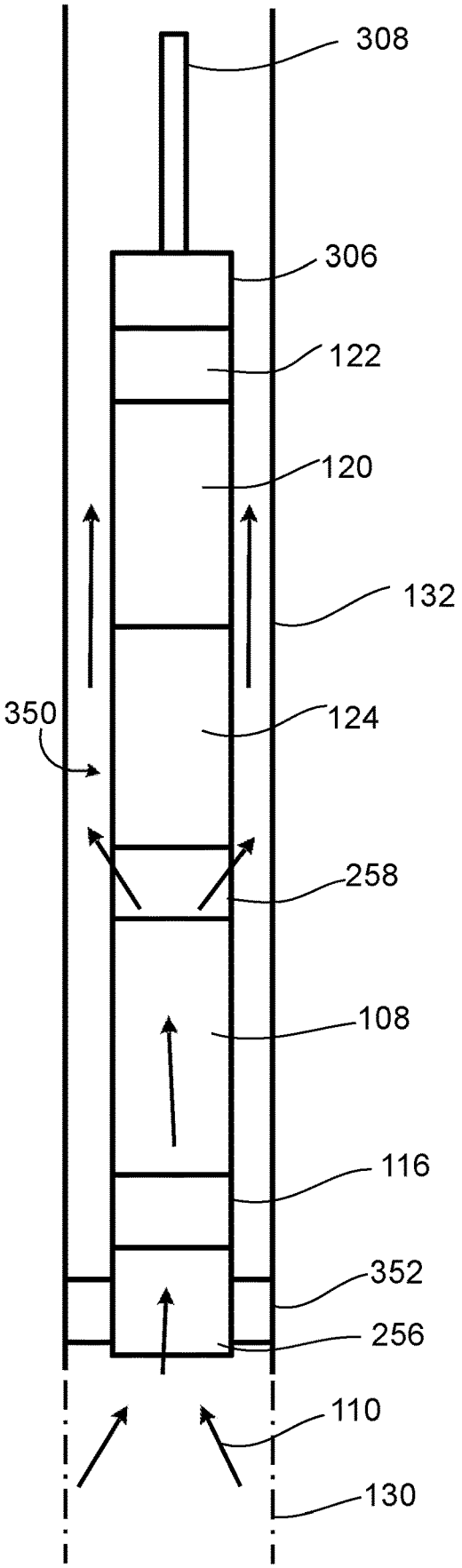
FIG. 6 is a cross-sectional view of an electric submersible pump assembly arranged in a wellbore.

FIG. 6 is a cross-sectional view of an electric submersible pump assembly 350 arranged in a wellbore 102. The ESP assembly 350 is substantially similar to the ESP assembly 300, however, the ESP assembly 350 is arranged in the casing 132, without the production tubing 302. In the inverted configuration, the pump 108, and density meter 116 are arranged axially downhole from the protector 124, motor 120, and the monitoring sub-system 122. The ESP assembly 350 further includes a packer 352, a fluid entrance 256 (stinger), a fluid discharge 258, and a cable adapter 306 connected to a power cable 308. The packer 352 isolates a portion of the wellbore below the packer 352 from the portions of the well uphole of the packer 352. In this pump configuration, the ESP assembly 350 can be deployed using a cable deployment system in which the assembly is suspended from the cable adapter 306 by the power cable 308. This configuration improves producing up the casing may be used with non-corrosive reservoir fluid. The cable deployed ESP assemblies can reduce installation time and can reduce retrieval time of the ESP assemblies as compared to tubing-deployed ESP assemblies, thereby increasing equipment uptime and reducing costs.

In use, the fluid 110 downhole of the packer 352 enters the fluid entrance 256. The fluid 110 then flows through the density meter 116 and the pump 108 and exits the ESP assembly via the fluid discharge 258. The density of the fluid can be calculated as previously described with reference to FIGS. 2A, 2B and 3. The fluid 110, then continues to flow towards the surface in the casing 132.

In some embodiments, the density meter can be installed separately as a stand-alone unit or can be integrated into the pump at an intake section of the pump.

In some cases, the sensor sub-assemblies includes a plurality of pressure sensors (e.g., more than two) to increase flexibility and accuracy and to provide an average reading for the high pressure and low pressure measurement locations In some cases, the pressure sensors of the sensor sub-assembly may be arranged at the same circumferential angle, however, some pressure sensors may be staggered. For example, in a case having two pressure sensors at the first (high pressure) location and two pressure sensors at the second (low pressure) location taps each for high-pressure and low-pressure measurements, the high-pressure sensors can be arranged at 90° and 270° circumferential angular position, whereas the low-pressure sensors can be arranged at 0° and 180° circumferential angular positions.

In some cases, the shaft is formed by multiple shaft sections. Each of the density meter, monitoring sub-system, and protector may be mounted on a shaft section. The shaft sections can be attached by shaft connections. z In some embodiments, the density meter is incorporated into a Cable-Deployed Artificial Lift system, for example, a Cable Deployed ESP system or any artificial lift system.

While the density meter has been described as upstream of the pump, some meters are not arranged directly upstream of the pump. Rather, the density meter may be installed at the pump discharge (downstream of the pump) or anywhere along the length of the ESP assembly.

While the density meter has been described as measuring the density of a fluid in a wellbore, the density meter may also be used at the surface to determine a density of a fluid.

While a density meter with one rotor and one diffuser has been described, some density meters include multiple diffusers and multiple rotors. This configuration may reduce the entrance effects that can occur in a single rotor configuration. For example, incorporating multiple rotors can provide a more stable flow condition that is at equilibrium. In addition, this configuration may increase accuracy by increasing the pressure of the measured fluid, thereby reducing measurement of low magnitude pressures when measuring or calculating the density. In such a density meter, first and second rotors are mounted on a shaft and are arranged in the interior volume of a diffuser. The first and second rotors rotate at the same speed, however, the first and second rotors can rotate at different speeds. The first rotor has a first measurement channel with a first inlet and a first outlet. The second rotor has a second measurement channel with a second inlet and a second outlet. The first and second rotors are aligned along the axis so that the outlet of the first rotor channel of the first rotor is fluidly connected to the inlet of the second rotor channel of the second rotor. The first inlet is arranged radially closer to the axis than the first outlet. The second inlet is arranged radially closer to the axis than the second outlet. In some cases, the first outlet is arranged radially closer to or equidistant to the axis than the second inlet. The first rotor has a first measurement channel that extends from the first outlet to the first inlet and the second rotor has a second measurement channel that extends from the second outlet to the second inlet. The first and second measurement channels are substantially similar to the measurement channel described with reference to FIGS. 2A and 2B.

A sensor sub-system includes a first pressure sensor disposed in the first measurement channel at a first radial distance relative to the axis and a second pressure sensor disposed downstream of the first pressure sensor. The second pressure sensor is arranged at a second radial distance relative to the axis. The first and second radial distances may be known. The first radial distance is radially farther from the axis than the second radial distance. In some cases, the first radial distance is radially closer to the axis than the second radial distance.

The sensor sub-system includes a third pressure sensor disposed in the second measurement channel at a third radial distance relative to the axis and a fourth pressure sensor disposed downstream of the third pressure sensor. The fourth pressure sensor is arranged at a fourth radial distance relative to the axis. The third and fourth radial distances may be known. The third radial distance is radially farther from the axis than the fourth radial distance. In some cases, the third radial distance is closer to the axis than the fourth radial distance.

In some density meters, the sensor sub-assembly includes one pressure sensor in each measurement channel of the rotors. For example, the first measurement channel of the first rotor includes a first pressure sensor and the second measurement channel of the second rotor includes a second pressure sensor.

In some density meters, a plurality of pressure sensors (e.g., two pressure sensors) are arranged in the second measurement channel. In some cases, no pressure sensors are disposed in the first measurement channel.

While the rotor has been described as operating at the same angular velocity as the motor, some rotors may include a speed reducer to proportionally reduce the angular velocity of the rotor relative to the motor. In some cases, the density meter is connected to the motor via the speed reduce rather than directly to the shaft.

What is claimed is:

1. An electric submersible pump assembly to measure a density of a fluid in a wellbore, the ESP assembly comprising:

a fluid entrance, a shaft extending from a first end of the assembly to a second end of the assembly along an axis, wherein the shaft is rotationally connected to a motor; and a density meter fluidly connected to the fluid entrance, the density meter comprising:

a diffuser having an interior volume defined by an inner surface, a rotor arranged in the interior volume of the diffuser and rotationally coupled to the motor via the shaft, the rotor comprising:

an interior wall, a partition having a first face and a second face opposite the first face, and a rotor channel defined by the first face of the partition of the rotor and the interior wall of the rotor, wherein the rotor channel extends from an inlet to an outlet, wherein the inlet is fluidly connected to the fluid entrance of the ESP assembly and is arranged at a first radial distance from the axis, wherein the outlet is arranged at a second radial distance from the axis, wherein the first radial distance of the inlet is less than the second radial distance of the outlet; and a measurement channel, wherein the measurement channel is defined by the inner surface of the diffuser and the second face of the partition of the rotor, wherein the measurement channel extends from the outlet of the rotor channel to the inlet of the rotor channel, and a sensor sub-assembly arranged on the inner surface of the diffuser, the sensor sub-assembly configured to measure at least two pressures in the measurement channel.

2. The electric submersible pump assembly according to claim 1, wherein the measurement channel is configured to flow fluid from the rotor channel.

3. The electric submersible pump assembly according to claim 1, wherein the measurement channel is arranged adjacent to the rotor channel.

4. The electric submersible pump assembly according to claim 1, wherein the sensor sub-assembly comprises a first pressure sensor arranged in the measurement channel at a first radial distance from the axis.

5. The electric submersible pump assembly according to claim 4, wherein the sensor sub-assembly comprises a second pressure sensor arranged in the measurement channel at a second radial distance from the axis, wherein the first radial distance of the first pressure sensor is greater than the second radial distance of the second pressure sensor.

6. The electric submersible pump assembly according to claim 5, wherein the first radial distance of the first pressure sensor is known.

7. The electric submersible pump assembly according to claim 5, wherein the second radial distance of the second pressure sensor is known.

8. The electric submersible pump assembly according to claim 1, further comprising:

one or more processors; and a computer-readable medium storing instructions executable by the one or more processors to perform operations comprising:

prompting the motor to rotate the rotor of the ESP assembly about the axis such that the fluid at the outlet of the rotor channel of the rotor is at a higher fluid pressure than the inlet of the rotor channel, wherein inlet of the rotor channel is arranged radially closer to the axis than the outlet of the rotor channel, prompting a first pressure sensor disposed in a measurement channel defined between the rotor and a diffuser to measure a first pressure, prompting a second pressure sensor disposed in the measurement channel to measure a second pressure, wherein the second pressure sensor is arranged downstream of the first pressure sensor and the second pressure sensor is arranged radially closer to the axis than the first pressure sensor.

9. The electric submersible pump assembly according to claim 8, wherein the operations further comprise determining the density of the fluid in the measurement channel based on the first pressure and the second pressure.

10. The electric submersible pump assembly according to claim 1, further comprising a pump configured to convey fluid in a first direction from the inlet on the rotor channel to the outlet of the rotor channel.

11. The electric submersible pump assembly according to claim 10, wherein the fluid flowing in the measurement channel flows in a second direction, opposite the first direction.

12. The electric submersible pump assembly according to claim 1, wherein the first radial distance of the inlet of the rotor channel is known.

13. The electric submersible pump assembly according to claim 1, wherein the second radial distance of the outlet of the rotor channel is known.

14. The electric submersible pump assembly according to claim 1, wherein a diffuser channel defined by the inner surface if the diffuser is fluidly connected to the outlet of the rotor channel and the fluid entrance of the ESP assembly.

15. The electric submersible pump assembly according to claim 14, wherein the diffuser channel is arranged downstream of the rotor channel.

16. The electric submersible pump assembly according to claim 1, wherein the rotor is rotatable relative to the diffuser.

17. The electric submersible pump assembly according to claim 1, wherein the fluid is an oil-water mixture.

18. The electric submersible pump assembly according to claim 1, wherein a total volume of the measurement channel is less than the total volume of the rotor channel.

19. The electric submersible pump assembly according to claim 18, wherein the total volume of the measurement channel is about 1% to about 20% of the total volume of the rotor channel.

20. The electric submersible pump assembly according to claim 1, wherein the ESP assembly further comprises a pump configured to convey the fluid from the first end of the ESP assembly to the second end of the ESP assembly, wherein the pump is arranged upstream of the density meter.

21. The electric submersible pump assembly according to claim 20, wherein the density meter forms an intake portion of the pump.

22. A method to determine a density of a fluid flowing in an electric submersible pump assembly, the method comprising: rotating a shaft, by a motor, at a predetermined angular velocity such that a rotor of the ESP, rotationally coupled to the shaft, rotates about an axis relative to a diffuser of the ESP assembly, wherein the rotor defines a rotor channel, sensing, by a first pressure sensor, a first pressure indicative of the pressure at a first location in a measurement channel, wherein the first location is at a first radial distance from the axis sensing, by a second pressure sensor, a second pressure indicative of the pressure at a second location in a measurement channel, wherein the second location is at a second radial distance from the axis, wherein the first radial distance is larger than the second radial distance.

23. The method according to claim 22, further comprising determining the density of the fluid based on the first and second pressures, the first radial distance, the second radial distance, and a predetermined angular velocity of the shaft.

24. The method according to claim 22, wherein the density is determined using the equation:

$$\rho = \frac{2(p_1 - p_2)}{\bar{k}^2\Omega^2(d_1^2 - d_2^2)}.$$

25. The method according to claim 22, wherein the method further comprises determining a water cut of the fluid.

26. The method according to claim 25, wherein the water cut is determined based on the determined density of the fluid, a predetermined density of water, and a predetermined density of oil.

27. The method according to claim 26, wherein the water-cut is determined using the equation; WC=P−Po/Pw−Po.

28. The method according to claim 22, wherein the fluid is an oil-water mixture.

* * * * *